US010030445B2

(12) United States Patent
Callahan et al.

(10) Patent No.: US 10,030,445 B2
(45) **Date of Patent: *Jul. 24, 2018**

(54) TRI-TRUSS SELF-CLOSING GATE

(71) Applicant: Cover Care, LLC, Westfield, IN (US)

(72) Inventors: Thomas Patrick Callahan, Nampa, ID (US); Patrick Edward Callahan, Escondido, CA (US)

(73) Assignee: Cover Care, LLC, Westfield, IN (US)

( * ) Notice: Subject to any disclaimer, the term of this patent is extended or adjusted under 35 U.S.C. 154(b) by 90 days.

This patent is subject to a terminal disclaimer.

(21) Appl. No.: 15/174,788

(22) Filed: Jun. 6, 2016

(65) Prior Publication Data

US 2016/0281387 A1 Sep. 29, 2016

Related U.S. Application Data

(63) Continuation of application No. 13/771,810, filed on Feb. 20, 2013, now Pat. No. 9,359,787.

(Continued)

(51) Int. Cl.

| | |
|---|---|
| ***E04H 17/16*** | (2006.01) |
| ***E06B 11/02*** | (2006.01) |
| ***E04H 17/00*** | (2006.01) |
| ***E04H 4/06*** | (2006.01) |
| ***E05B 65/00*** | (2006.01) |
| ***E06B 11/04*** | (2006.01) |
| ***E04H 17/04*** | (2006.01) |
| ***E04H 17/22*** | (2006.01) |

(52) U.S. Cl.

CPC ..... *E06B 11/021* (2013.01); *E04H 4/06* (2013.01); *E04H 17/00* (2013.01); *E04H 17/04* (2013.01);

(Continued)

(58) Field of Classification Search

CPC ..... E04H 17/00; E04H 4/06; E04H 17/04; E04H 17/22; E04H 17/163;

(Continued)

(56) References Cited

U.S. PATENT DOCUMENTS

| | | | |
|---|---|---|---|
| 1,153,560 | A | 9/1915 | Miller |
| 2,766,015 | A | 10/1956 | Farmer |

(Continued)

FOREIGN PATENT DOCUMENTS

| | | | |
|---|---|---|---|
| FR | 2862684 | A1 | 5/2005 |
| GB | 1201532 | A | 8/1970 |

OTHER PUBLICATIONS

Final Office Action dated Oct. 13, 2016 in U.S. Appl. No. 15/234,646, filed Aug. 11, 2016.

Final Office Action dated May 7, 2015 in U.S. Appl. No. 13/771,810, filed Feb. 20, 2013.

Office Action dated Oct. 28, 2014, in U.S. Appl. No. 13/771,810, filed Feb. 20, 2013.

*Primary Examiner* — Amber Anderson
*Assistant Examiner* — Nahid Amiri
(74) *Attorney, Agent, or Firm* — Phillips, Ryther & Winchester; Justin Flanagan

(57) ABSTRACT

Systems and methods of fencing systems are provided that incorporate tri-truss assemblies and/or self-closing gates. A tri-truss assembly may provide stability and support to a gate that is part of a portable or temporary fencing system. A tri-truss assembly may be configured to support a self-closing gate that is part of a pool fence. A tri-truss assembly may include three vertical support members. Two of the three vertical support members may include pins configured to be placed within pre-drilled holes in a surface in order to maintain the tri-truss assembly upright. A third vertical support may be a different length (shorter or longer) than the first two vertical support members and include an adjustable foot, such as a threaded bolt, configured to contact the surface and provide additional stability and/or support.

21 Claims, 8 Drawing Sheets

Related U.S. Application Data

(60) Provisional application No. 61/614,239, filed on Mar. 22, 2012.

(52) U.S. Cl.
CPC ..... *E04H 17/163* (2013.01); *E04H 17/22* (2013.01); *E05B 65/0007* (2013.01); *E06B 11/022* (2013.01); *E06B 11/028* (2013.01); *E06B 11/04* (2013.01)

(58) Field of Classification Search
CPC .. E05B 65/0007; E05B 11/021; Y10T 16/458; Y10T 16/459; Y10T 16/462; Y10T 16/498; E06B 11/021; E06B 11/22; E06B 11/04; E06B 11/028
USPC ..... 256/1, 13.1, 24–31, 65.14, 73, DIG. 5; 49/501; D25/38.1, 45
See application file for complete search history.

(56) References Cited

U.S. PATENT DOCUMENTS

| | | | |
|---|---|---|---|
| 2,872,161 | A | 2/1959 | Olson |
| 3,307,565 | A | 3/1967 | Luccarelli |
| 5,242,160 | A | 9/1993 | Girard et al. |
| 5,664,769 | A | 9/1997 | Sadinsky et al. |
| 6,349,512 | B1 | 2/2002 | Berkey et al. |
| 6,666,435 | B2 | 12/2003 | Blosfelds et al. |
| 7,500,655 | B1 | 3/2009 | Smith et al. |
| 7,677,534 | B2 | 3/2010 | Langenwalter |
| 8,490,287 | B2 | 7/2013 | Barter et al. |
| 8,579,262 | B2 | 11/2013 | Sadinsky et al. |
| 9,359,787 | B2 | 6/2016 | Callahan et al. |
| 2006/0231821 | A1 | 10/2006 | Gavin |
| 2016/0281387 | A1 | 9/2016 | Callahan et al. |

TRI-TRUSS SELF-CLOSING GATE

RELATED APPLICATIONS

This application is a continuation of and claims priority to U.S. patent application Ser. No. 13/771,810 filed on Feb. 20, 2013 titled "Tri-Truss Self-Closing Gate," which application claims the benefit under 35 U.S.C. § 119(e) of U.S. Provisional Patent Application No. 61/614,239 filed Mar. 22, 2012, titled "TRI-TRUSS SELF-CLOSING GATE," both of which applications are incorporated herein by reference in their entireties.

TECHNICAL FIELD

This disclosure generally relates to self-closing gates and doors. For example, this disclosure describes self-closing gates for portable, removable, and/or temporary fences, such as those, for example, around a swimming pool.

BRIEF DESCRIPTION OF THE DRAWINGS

Non-limiting and non-exhaustive embodiments of the disclosure are described, including various embodiments of the disclosure with reference to the figures described below.

Figure 1:
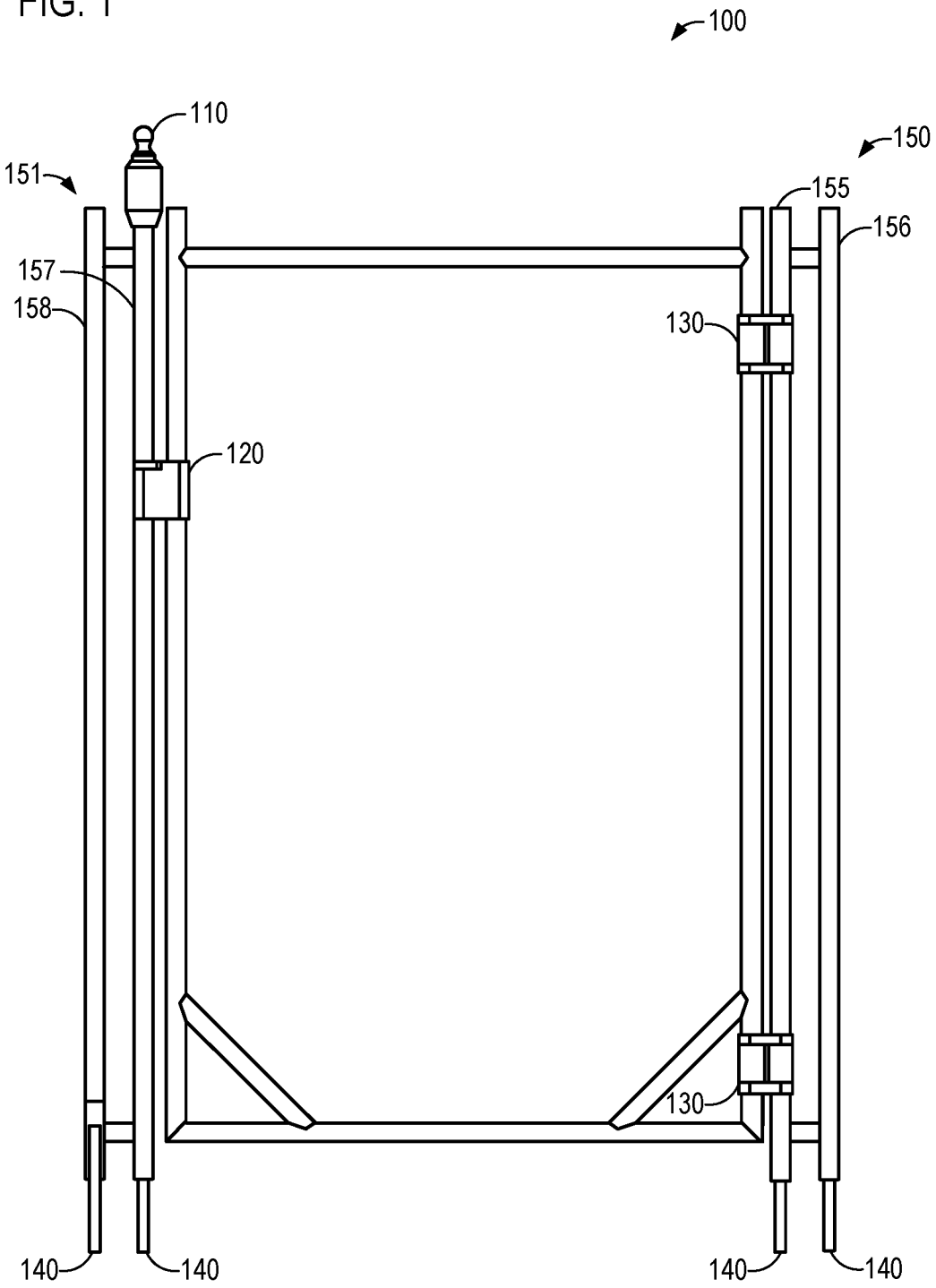
FIG. 1 illustrates a front view of a left tri-truss assembly and a right tri-truss assembly supporting a framework of a self-closing gate.

In the following description, numerous specific details are provided for a thorough understanding of the various embodiments disclosed herein. However, any of a wide variety of configurations and materials may be used. In addition, in some cases, well-known structures, materials, or operations may not be shown or described in detail in order to avoid obscuring aspects of the disclosure.

DETAILED DESCRIPTION

The present disclosure provides various embodiments of systems and methods of fencing systems incorporating tri-truss assemblies and self-closing gates. In various embodiments, a tri-truss assembly is configured to provide stability and support to a gate that is part of a portable or temporary fencing system. For example, tri-truss assemblies may be configured to support a self-closing gate that is part of a pool fence. A tri-truss assembly may be utilized in conjunction with any type of fence or gate system that is meant to be permanently, semi-permanently, or temporarily installed. A tri-truss assembly may be secured to a lower surface in any number of ways, including via cement, bolts, adhesives, weights, pins, adjustable platforms, and/or any of a wide variety of fasteners.

In various embodiments, a tri-truss assembly includes three vertical support members. Two of the three vertical support members may include pins configured to be placed within pre-drilled holes in a surface in order to maintain the tri-truss assembly upright. A third vertical support may be a different length (shorter) than the first two vertical support members and include an adjustable foot, such as a threaded bolt, configured to contact the surface and provide additional stability and/or support.

The tri-truss assemblies may be utilized in conjunction with any fence section, fencing material, wall, gate, door, and/or other barrier component. According to the examples provided herein, the tri-truss assemblies are described in conjunction with a self-closing gate. For example, the gate may include a U-shaped framework. Mesh material may be secured to the framework, such that the mesh material is secured to the upper most portion of the gate and forms a barrier. The gate may be a self-closing gate. In some embodiments, the gate may include a bowed top framework portion to provide additional support and/or facilitate self-closing. In such embodiments, the mesh fencing material may not be in contact with the bowed top framework. Rather, the mesh fencing material may be pulled taught, but not attached to the top framework, or the mesh fencing material may be secured to a secondary top framework section that is not bowed.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment.

In the embodiments depicted in the drawings, the size, shape, orientation, placement, configuration, and/or other characteristics of supports, fencing materials, pins, bars, and other components are merely intended as examples, any number of variations are included within the scope of this disclosure. Specifically, any of a wide variety of fencing materials, including privacy and non-privacy types, may be used in conjunction with the presently described tri-truss assemblies and self-closing gates. For example, the tri-truss assemblies and self-closing gates described herein may be utilized in conjunction with privacy fencing materials, non-privacy fencing materials (including those specifically designed to be unobtrusive), flexible materials, rigid materials, materials intended for permanent use, materials intended for temporary use, and/or any other type of barrier material.

The embodiments of the disclosure will be best understood by reference to the drawings, wherein like parts are designated by like numerals throughout. The components of the disclosed embodiments, as generally described and illustrated in the figures herein, could be arranged and designed in a wide variety of different configurations. Thus, the following detailed description of the various embodiments of tri-truss assemblies and self-closing gate systems is not intended to limit the scope of the disclosure, but is merely representative of possible embodiments.

FIG. 1 illustrates a front view of a left tri-truss assembly 151 and a right tri-truss assembly 150 supporting a framework for a self-closing gate 100. The tri-truss assemblies 150 and 151 may be configured to support the self-closing gate 100. The tri-truss assemblies 150 and 151 and the self-closing gate 100 may be part of a fence or other barrier. For example, they may be components within a fence that surrounds a pool, where the self-closing gate 100 allows access to the pool. In the front view of the tri-truss assemblies 150 and 151, only a first vertical support member 155 and 157 and second vertical support member 156 and 158 are visible. A third vertical support member is obscured by the front vertical support members 155, 156, 157, and 158. The third vertical support members are described in conjunction with FIGS. 2-7.

As illustrated, one side of self-closing gate 100 may be pivotably attached to the first vertical support member 155 of the right tri-truss assembly 150. For example, the self-closing gate 100 may be pivotably attached via hinges 130. The first vertical support member 155 of the right tri-truss assembly 150 may be connected to the second vertical support member 156. In the illustrated embodiment, the first vertical support member 155 and the second vertical support member 156 are connected in substantially the same plane as the self-closing gate 100 in the closed position. In alternative embodiments, the second vertical support member 156 may be connected to the first vertical support member 155 at any angle relative to the plane of self-closing gate 100.

The second side of the self-closing gate 100 may be selectively latched to the left tri-truss assembly 151. For example the second side of the self-closing gate 100 may be selectively latched to or near the first vertical support member 157 of the left tri-truss assembly 151. A latching mechanism 120 may selectively secure the self-closing gate 100 in a closed position adjacent the first vertical support member 157 of the left tri-truss assembly 151. A latch release 110 may allow the self-closing gate 100 to be selectively unlatched. The latch release 110 may release the self-closing gate 100 from the latching mechanism 120, allowing the self-closing gate 100 to pivot about the hinges 130 to an open position. According to various embodiments, the self-closing gate 100 may utilize any of a wide variety of self-closing mechanisms, including tension mechanisms, springs, pulleys, weights, hydraulics, and other self-closing gate mechanisms. The self-closing mechanisms may be incorporated into the gate itself, the hinges, secured to the ground or other surface, and/or be incorporated into the fencing material itself. According to various embodiments described herein, the self-closing gate 100 may incorporate self-closing hinges 130 that secure self-closing gate 100 to the first vertical support member 155.

The tri-truss assemblies 150 and 151 may be secured to a lower surface in any number of ways, including via cement, bolts, adhesives, weights, and/or any of a wide variety of fasteners. In the illustrated embodiment, the pins 140 extend from the lower portion of the first and second vertical support members 155, 156, 157, and 158. The pins 140 may be inserted into a hole formed in a lower surface. For example, holes may be formed in a concrete surface for the pins 140 to be inserted into the concrete surface. The pins 140 may be configured to provide sufficient support to maintain the tri-truss assemblies 150 and 151 in an upright position, extending substantially orthogonal to the plane formed by the lower surface.

The length, shape, material, and strength of the pins 140 may vary based on the characteristics of the connected fence and/or gate. Additionally, the pins 140 may vary based on the type of surface they penetrate. For example, the pins 140 may be pointed and/or tapered so as to more easily penetrate dirt or grass. As another example, they may be cylindrical and configured to enter pre-drilled holes in a concrete swimming pool deck. According to various embodiments, the pins 140 may be between one and twelve inches in length and made of a metal, such as stainless steel. Alternative sizes, shapes, materials, and/or other characteristics may be used to suit a particular application.

Figure 2:
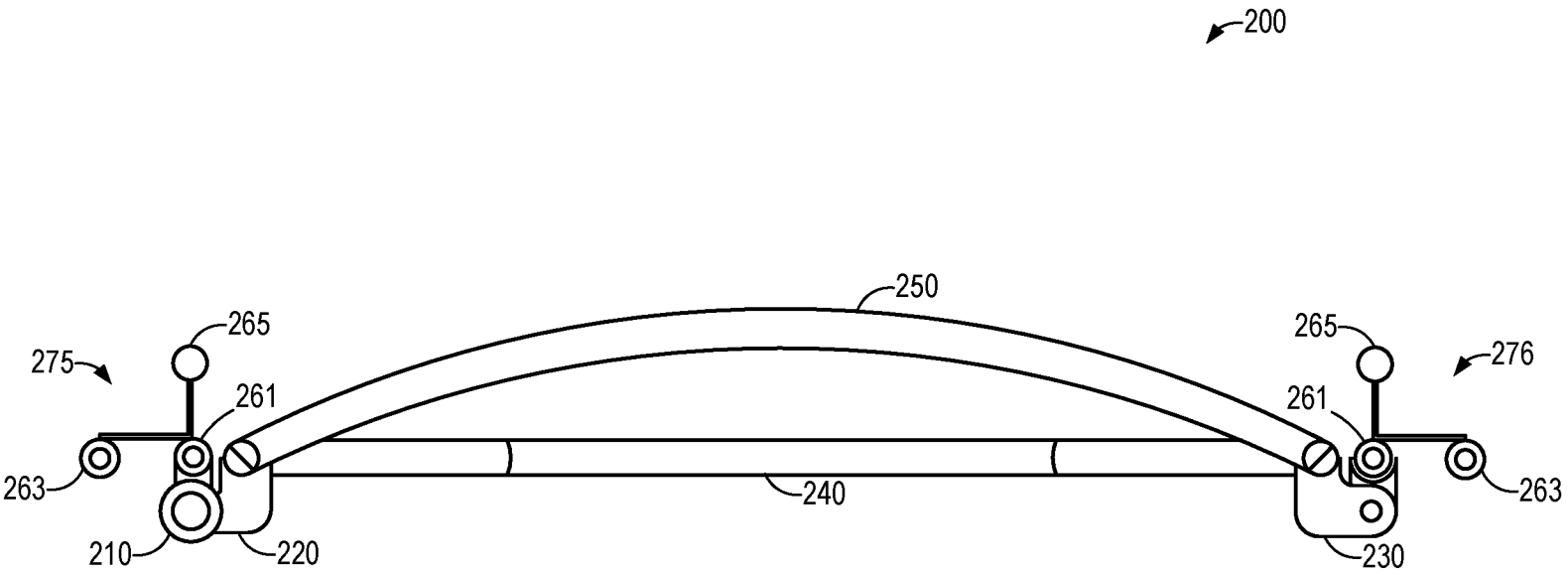
FIG. 2 illustrates a top view of left tri-truss assembly and right tri-truss assembly supporting a framework of a self-closing gate.

FIG. 2 illustrates a top view of a left tri-truss assembly 275 and a right tri-truss assembly 276 supporting a self-closing gate 200. In the illustrated embodiment, the self-closing gate 200 includes a lower frame portion 240 in relatively close proximity to the lower support surface (e.g., a concrete swimming pool deck) and an upper frame portion 250. According to various embodiments, the upper frame portion 250 may be bowed so as not to contact the fencing material used with the self-closing gate 200. The self-closing gate 200 may be secured to the right tri-truss assembly 276 via one or more pivotable members, such as hinges. The self-closing gate 200 may include one or more self-closing mechanisms, such as a self-closing hinge 230. The self-closing hinge 230 may pivotably secure the self-closing gate 200 to the right tri-truss assembly 276. A latching mechanism 220 may selectively secure the self-closing gate 200 in a closed position, i.e. secured to or secured adjacent to the left tri-truss assembly 275. A latch release 210 may selectively release the latching mechanism 220 in order for the self-closing gate 200 to open. Although the various examples provided herein describe the tri-truss assemblies utilized in conjunction with a self-closing gate, any of a wide variety of doors, gates, portals, fencing sections, fencing materials, and/or other barriers may be utilized in conjunction with the tri-truss assemblies provided herein.

As illustrated in the top view of FIG. 2, each tri-truss assembly 275 and 276 includes three vertical support members: a first, inner vertical support member 261 closest to self-closing gate 200; a second, outer vertical support member 263 attached to the first vertical support member 261; and a third vertical support member 265 at an angle (illustrated as ninety degrees herein) relative to the line formed by the first 261 and second 263 vertical support members. The outer vertical support member 263 may be in substantially the same plane as the self-closing gate 200. Alternatively, the outer vertical support member 263 may be offset from the plane of the self-closing gate 200.

Figure 3B:
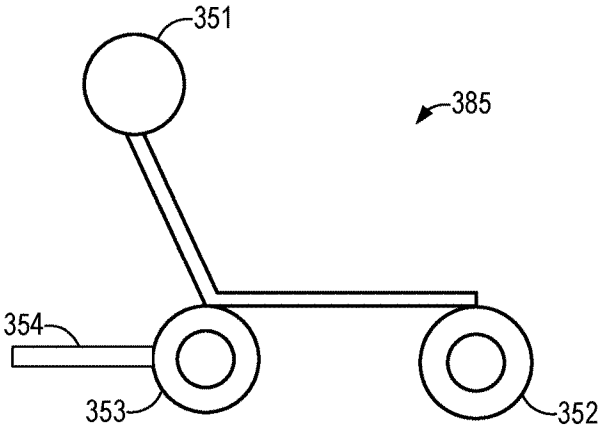
FIG. 3A-3C illustrates top views of three variations of tri-truss assemblies.
Figure 3C:
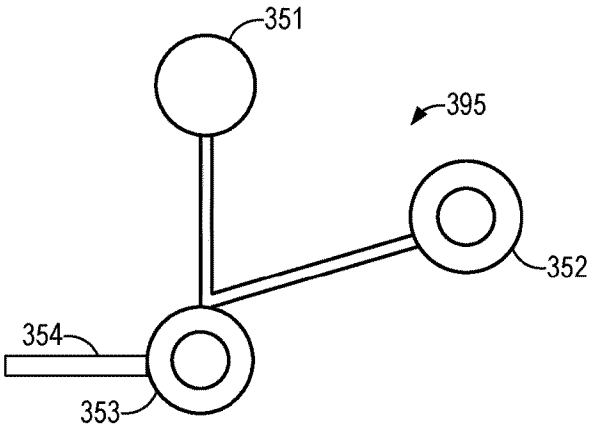
Figure 3A:
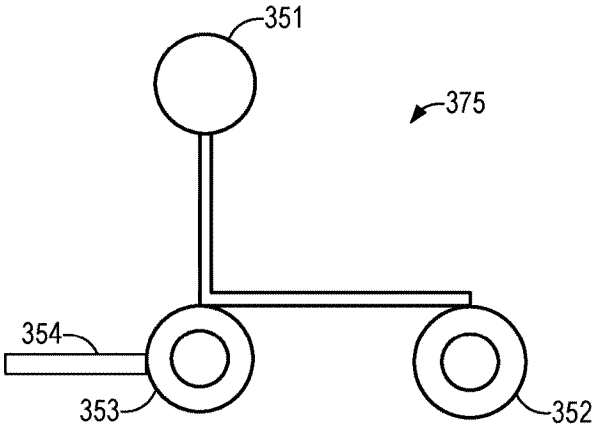

FIG. 3A illustrates a tri-truss assembly 375 according to an embodiment in which a first vertical support member 353 and a second vertical support member 352 are connected in substantially the same plane as a closed gate 354. A third vertical support member 351 may be connected at a ninety degree angle relative to a line formed by the first 353 and the second 352 vertical support members.

FIG. 3B illustrates an alternative embodiment of a tri-truss assembly 385, in which the first vertical support member 353 and the second vertical support member 352 are connected in substantially the same plane as the closed gate 354. However, the third vertical support member 351 may be connected at an obtuse (illustrated) or acute (not illustrated) angle relative to the line formed by the first 353 and the second 352 vertical support members.

FIG. 3C illustrates another embodiment of a tri-truss assembly 395. As illustrated, the second 352 and the third 351 vertical support members are each connected to the first 353 vertical support member at an angle relative to the plane formed by closed gate 354. In some embodiments the gate 354 may be a self-closing gate. In other embodiments, the gate 354 may be replaced or supplemented by any of a wide variety of gates, doors, portals, fencing sections, and/or barriers.

Figures 4A, 4B:
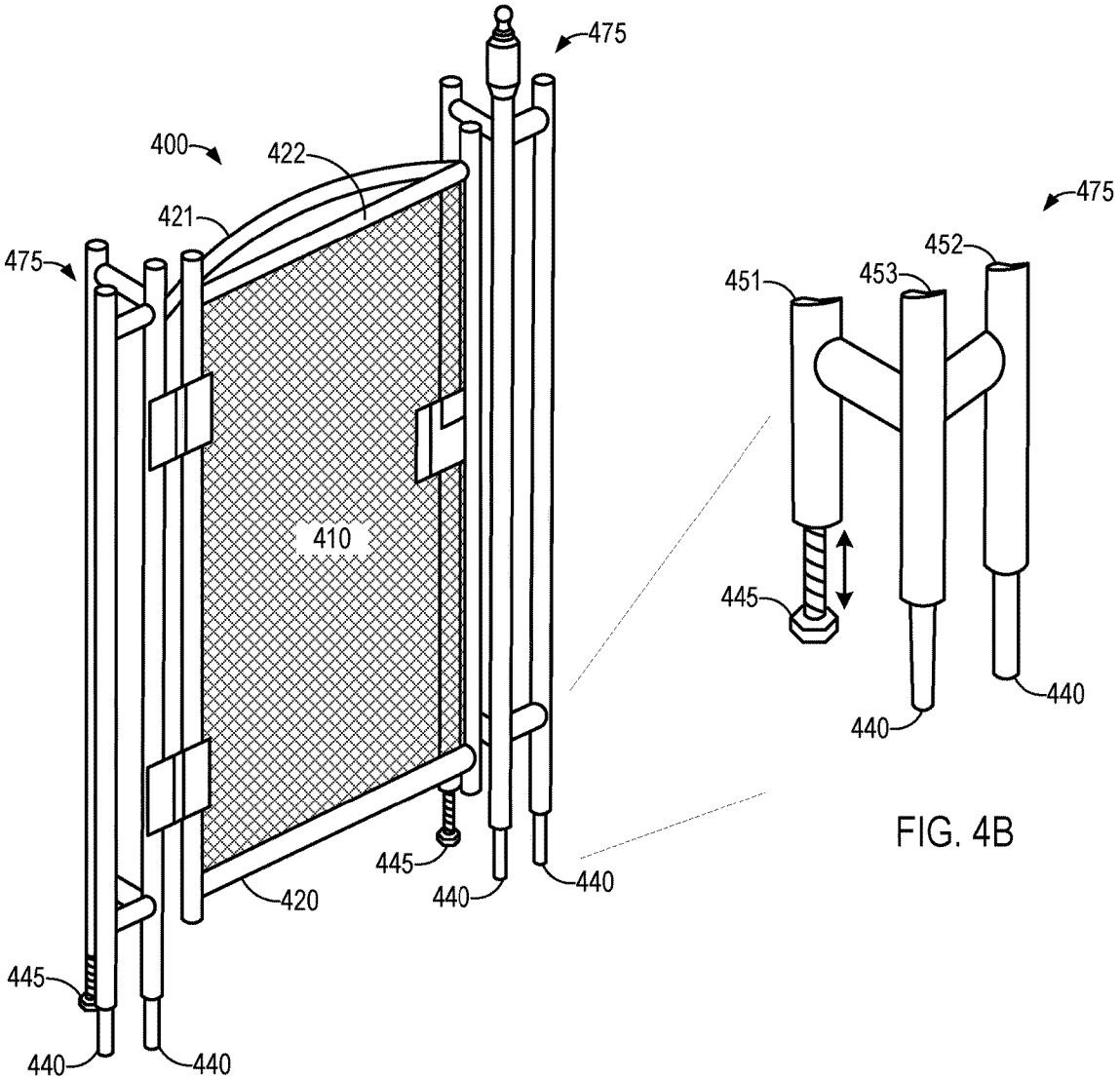
FIG. 4A illustrates a perspective view of a self-closing gate secured between two tri-truss assemblies.
FIG. 4B illustrates a close-up view of ground pins and an adjustable support positioned within the poles of the tri-truss assemblies.

FIG. 4A illustrates a perspective view of a self-closing gate 400 secured between two tri-truss assemblies 475. As illustrated, the self-closing gate 400 may include a mesh wall 410 supported by a lower frame portion 420, an upper frame portion 422, and a bowed frame portion 421. In some embodiments, the upper frame portion 422 and/or the bowed frame portion 421 may be omitted. Additional frame supports may be added for a particular application and/or as needed to increase structural integrity. For example, diagonal or cross supports may be utilized to increase the structural integrity of the self-closing gate 400.

As illustrated in the close-up view of FIG. 4B, each tri-truss assembly 475 may include three vertical support members. A first vertical support member 453 may directly support the self-closing gate 400. A second vertical support member 452 may be connected to first vertical support member 453 and configured to be connected to a section of a fence. A third vertical support member 451 may provide additional support and/or strength to the tri-truss assembly 475.

As previously described, the tri-truss assembly 475 may be secured to a lower surface, such as dirt, grass, concrete, tile, rock, composite, brick, and/or other surface material, using any of a wide variety of securing mechanisms. For example, the tri-truss assembly 475 may be secured to a surface using pins 440 (e.g., stainless steel) inserted within pre-drilled holes in a surface. Additionally or alternatively, an adjustable support 445 may protrude from one or more of vertical support members 451, 452, and/or 453. As illustrated, the first 453 and the second 452 vertical support members may be configured with steel pins configured to enter pre-drilled holes in a surface (e.g., a concrete pool deck) and the third vertical support member 451 may include an adjustable support 445. The adjustable support 445 may be a threaded member, a quick release member, a locking member, a quick release pin, and/or other continuously or incrementally adjustable support.

In the illustrated embodiment, the adjustable support 445 comprises a threaded foot 445 configured to thread in and out of the third vertical support member 451. Any of a wide variety of adjustable supports (e.g., a foot, a peg, a platform) may be used in place of the threaded foot 445. Again, any of a wide variety of adjustment mechanisms may be employed in place of threads. For example, a quick release foot, or a self-locking adjustable foot may be employed. Though illustrated with a self-closing gate 400, the tri-truss assembly 475 may provide advantages over bi-truss or single-truss assemblies using any type of gate or fence structure. For example, the tri-truss assembly 475 coupled with the self-closing gate 400 may provide additional support and/or stability over conventional bi-truss and single-truss gate assemblies.

Figure 5:
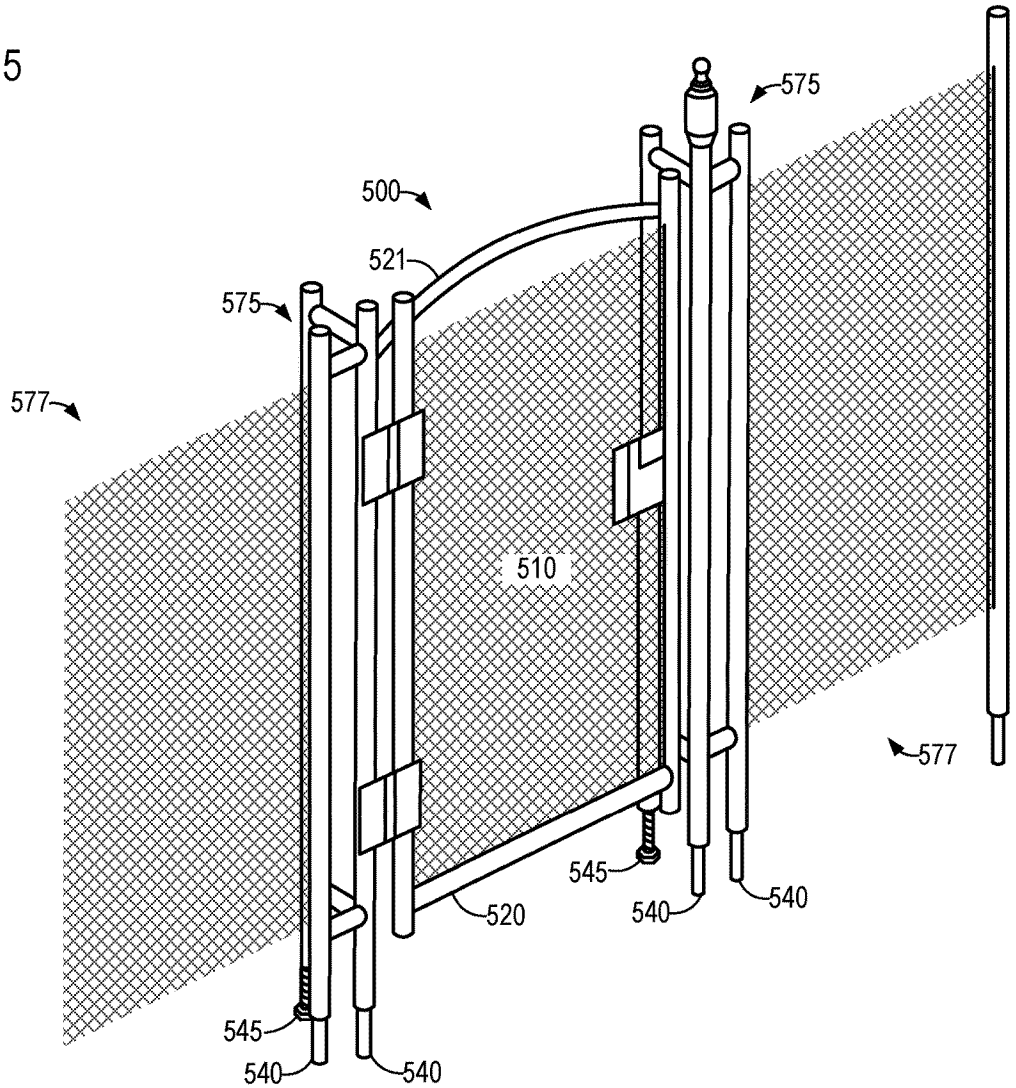
FIG. 5 illustrates a perspective view of a gate secured between two tri-truss assemblies, according to one embodiment.

FIG. 5 illustrates a perspective view of a gate 500 secured between two tri-truss assemblies 575, according to one embodiment. As illustrated, sections of fence 577 may be supported by one of the vertical support members of each of the tri-truss assemblies 575. The tri-truss assemblies 575 may support a pivotable gate 500 via other vertical support members. The gate 500 may be a self-closing gate in some embodiments. As illustrated, a top edge of a mesh wall 510 of the gate 500 may be unsupported. A top bar 521 of the gate 500 may be bowed outward, upward, and/or downward. Additional frame supports 520 may be added for a particular application and/or as needed to increase structural integrity. For example, diagonal or cross supports may be utilized to increase the structural integrity of the gate 500.

As previously described, each tri-truss assembly 575 may include three vertical support members. The first vertical support member may directly support the gate 500. The second vertical support member may be connected to the first vertical support member and configured to be connected to a section of a fence. The third vertical support member may provide additional support and/or strength to the tri-truss assembly 575. For example, the tri-truss assembly 575 may be secured to a lower surface, such as dirt, grass, concrete, tile, rock, composite, brick, and/or other surface material, using any of a wide variety of securing mechanisms. For example, the tri-truss assembly 575 may be secured to a surface using pins 540 (e.g., stainless steel) inserted within pre-drilled holes in a surface. Additionally or alternatively, an adjustable support 545 may protrude from one or more of vertical support members.

In the illustrated embodiment, the adjustable support 545 comprises a threaded foot 545 configured to thread in and out of the third vertical support member. As in previous embodiments, any of a wide variety of adjustable supports (e.g., a foot, a peg, a platform) may be used in place of the threaded foot 545. Again, any of a wide variety of adjustment mechanisms may be employed in place of threads. For example, a quick release foot or a self-locking adjustable foot may be employed. The tri-truss assemblies 575 may provide advantages over bi-truss or single-truss assemblies using any type of gate or fence structure.

Figure 6:
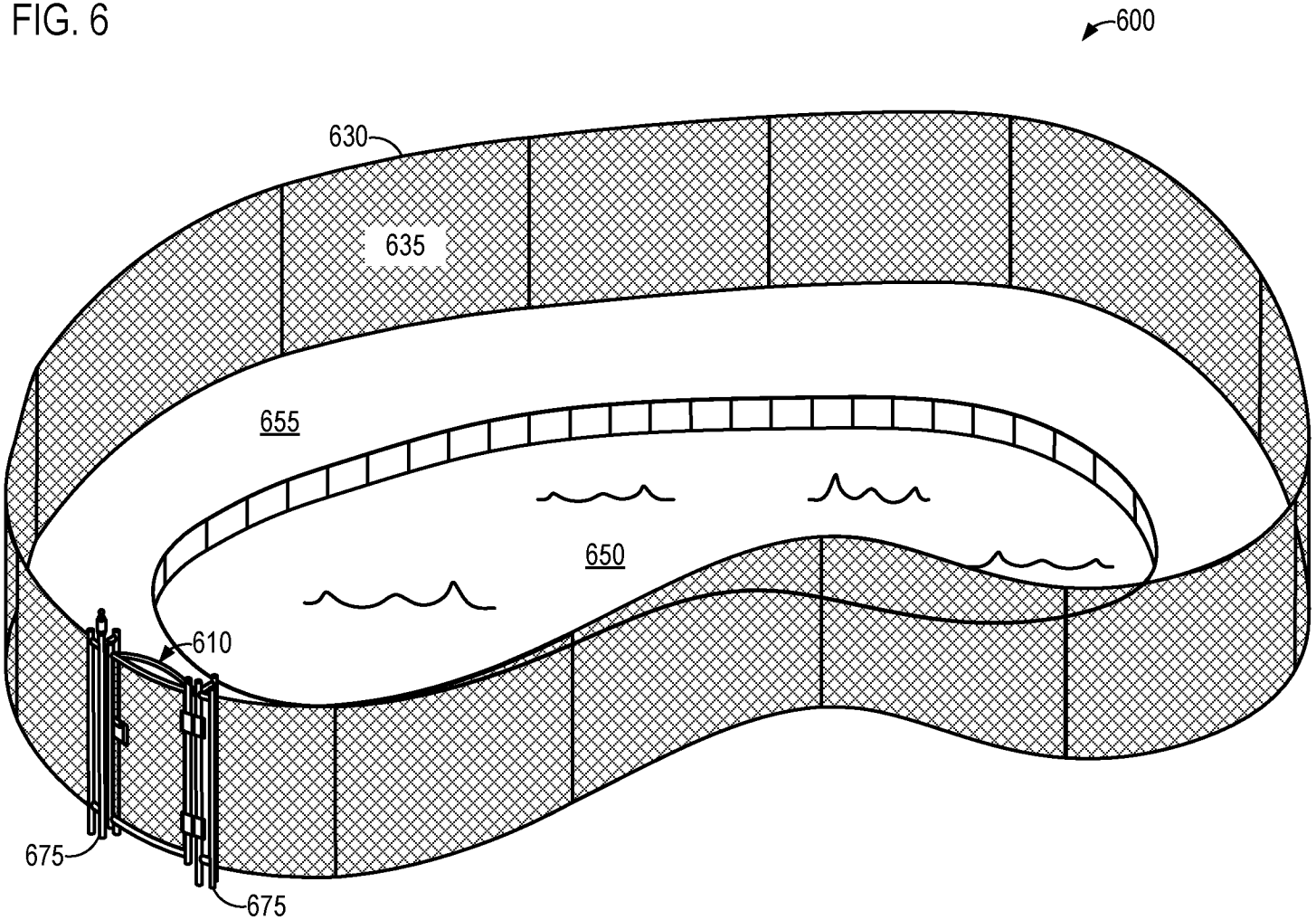
FIG. 6 Illustrates a perspective view of tri-truss assemblies supporting a self-closing gate utilized in conjunction with a fence surrounding a swimming pool.

FIG. 6 Illustrates a perspective view of a self-closing gate 610 supported by tri-truss assemblies 675. The self-closing gate 610 is part of a fence system 600 including a fence 630, tri-truss assemblies 675, and a surface 655 surrounding a pool 650. The fence system 600 may be configured to prevent children, guests, and/or pets from entering the pool 650. The fencing material may be a mesh 635 or other fencing type and may be manufactured from any of a wide variety of materials. According to various embodiments, the fence system 600 may be configured as a temporary or semi-permanent fence system 600. According to one such embodiment, each portion of the fence 630 may be secured via pins and/or rods into the surface 655. Similarly, the tri-trusses 675 may be secured in an upright position via pins and/or adjustable supports, as described herein. The tri-truss configuration may provide additional support and/or strength for the self-closing gate 610.

Figure 7:
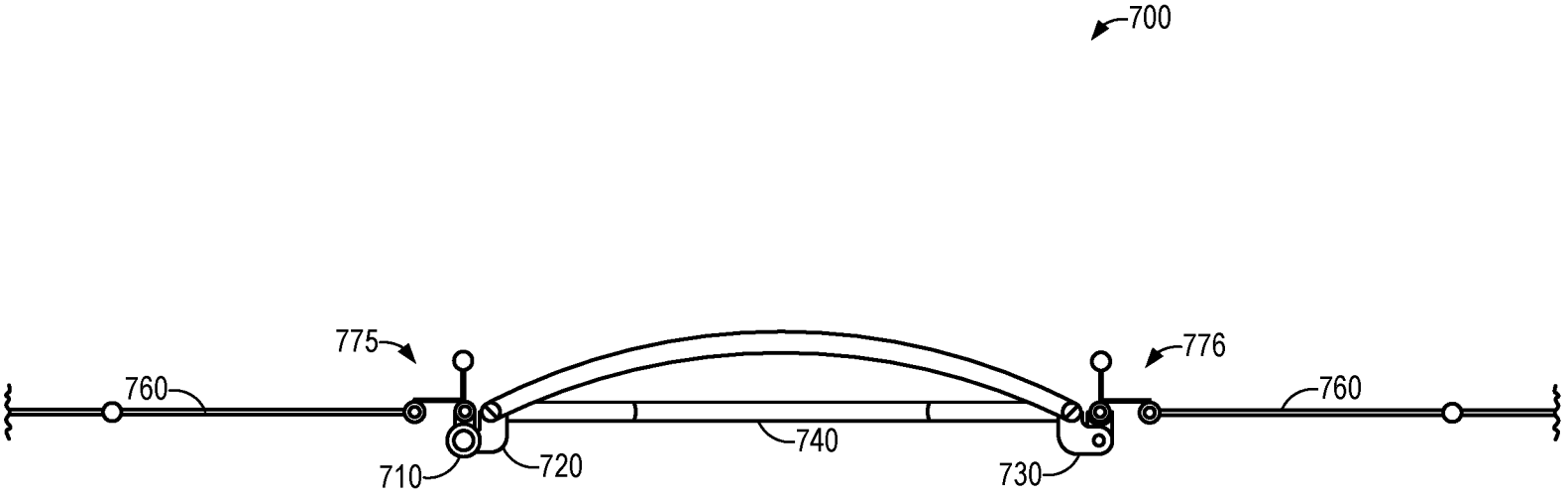
FIG. 7 illustrates a top view of tri-truss assemblies securing a self-closing gate in a closed position.

FIG. 7 illustrates a top view of a fencing system 700 including tri-truss assemblies 775 and 776 that secure a self-closing gate 740 in a closed position. The tri-truss assemblies 775 and 776 may also support sections of the fence 760. The fence 760 may comprise any of a wide variety of fence materials and/or types, including a mesh fence configured to maximize visibility while still preventing unwanted guests, such as children and pets, from entering an enclosed area. The self-closing gate 740 may be pivotably secured to the tri-truss assembly 776 via a self-closing hinge 730. A latching system, comprising a latch release 710 and a latching mechanism 720, may selectively secure the self-closing gate 740 in a closed position.

Figure 8:
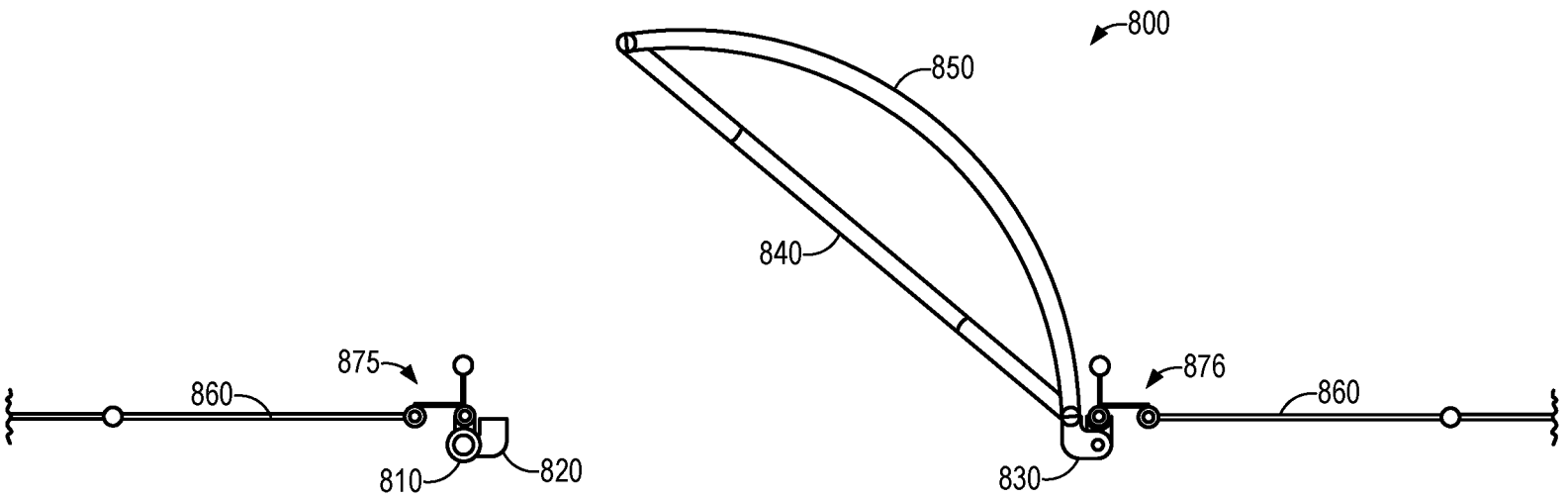
FIG. 8 illustrates a top view of tri-truss assemblies securing a self-closing gate in an open position.

FIG. 8 illustrates a top view of a fencing system 800 including tri-truss assemblies 875 and 876 securing a self-closing gate 840 in an open position. The tri-truss assemblies 875 and 876 may also support sections of the fence 860. Similar to the embodiments described above, the fence 860 may comprise any of a wide variety of fence types, materials, configurations, sizes, heights, and/or other barrier characteristics. The self-closing gate 840 may be pivotably secured to the tri-truss 876 via a self-closing hinge 830. A latching system, comprising a latch release 810 and a latching mechanism 820, may selectively secure the self-closing gate 840 in a closed position. In some embodiments, the bowed frame portion 850 may be configured to actively close the self-closing gate 840. Various portions of the fence 860, the self-closing gate 840, and/or the tri-truss assemblies 875 and 876 may be configured to be straight or curved for a particular application.

The above description provides numerous specific details for a thorough understanding of the embodiments described herein. However, those of skill in the art will recognize that one or more of the specific details may be omitted, modified, and/or replaced by a similar process or system. Various combinations of the embodiments described herein are possible and within the scope of this disclosure. Specifically, any variation described in conjunction with one embodiment may be applied to other embodiments.

What is claimed:

1. A barrier system comprising:

a first truss assembly comprising:

a first vertical support member; and a second vertical support member secured substantially parallel to the first vertical support member;

a gate having a first side pivotally attached to the first truss assembly such that the gate is configured to pivot between at least an open position and a closed position, wherein the gate comprises a framework for securing a mesh material along a bottom edge, a first side edge, and a second side edge, such that a top edge of the mesh material is unsecured, wherein the bottom edge, the first side edge, and the second side edge of the framework are substantially within a first plane;

a top bar connected to the framework that extends out of the first plane of the framework; and a second truss assembly configured to receive a second side of the gate when the gate is in the closed position, the second truss assembly comprising:

a first vertical support member; and a second vertical support member secured substantially parallel to the first vertical support member.

2. The barrier system of claim 1, wherein the second truss assembly is configured to selectively receive the second side of the gate when the gate is in the closed position via a latching system.

3. The barrier system of claim 1, wherein the framework comprises a U-shaped framework.

4. The barrier system of claim 1, wherein at least one of the first truss assembly and the second truss assembly comprises a tri-truss assembly, the tri-truss assembly further comprising:

a third vertical support member secured to the first vertical support member such that a plane formed by the first and third vertical support members is at an angle with respect to a plane defined by the first and second vertical support members.

5. The barrier system of claim 4, wherein the third vertical support member of at least one of the first and second tri-truss assemblies is secured to the first vertical support member of the at least one tri-truss assembly such that a plane formed by the first and third vertical support members is at a ninety degree angle with respect to the plane defined by the first and second vertical support members of the at least one tri-truss assembly.

6. The barrier system of claim 4, wherein the third vertical support member of at least one of the first and second tri-truss assemblies is secured to the first vertical support member of the at least one tri-truss assembly such that a plane formed by the first and third vertical support members is at an acute angle with respect to the plane defined by the first and second vertical support members of the at least one tri-truss assembly.

7. The barrier system of claim 4, wherein the third vertical support member of at least one of the first and second tri-truss assemblies is secured to the first vertical support member of the at least one tri-truss assembly such that a plane formed by the first and third vertical support members is at an obtuse angle with respect to the plane defined by the first and second vertical support members of the at least one tri-truss assembly.

8. The barrier system of claim 1, wherein at least one of the first and second vertical support members of at least one of the first and second tri-truss assemblies comprises a pin extending from an end of the support member, and wherein the pin is configured to enter a hole in a surface and provide support for the tri-truss assembly to remain upright.

9. The barrier system of claim 4, wherein the third vertical support member of at least one of the first and second tri-truss assemblies comprises an adjustable support configured to contact a surface and provide support for the at least one tri-truss assembly to remain upright, the adjustable support configured to selectively adjust the effective length of the third vertical support member.

10. The barrier system of claim 9, wherein the adjustable support comprises a threaded member configured to threadably extend from and retract into an end of the third vertical support member.

11. The barrier system of claim 1, wherein the top bar connected to the framework bows outward from the first plane of the framework.

12. A barrier system comprising:

a first tri-truss assembly including a first vertical support member, a second vertical support member, and a third vertical support member;

a second tri-truss assembly including a first vertical support member, a second vertical support member, and a third vertical support member; and a gate positioned between the first and second tri-truss assemblies, a first side member of the gate pivotally attached to the first vertical support member of the first tri-truss assembly, a second side member of the gate configured to be selectively secured adjacent the first vertical support member of the second tri-truss assembly, and a bottom framework member of the gate connecting the first and second side members of the gate;

a top framework member that extends outward from a plane defined by the first side member of the gate and the second side member of the gate; and a mesh secured to the first side member of the gate, the second side member of the gate, and the bottom framework member of the gate, such that a top edge of the mesh is unsecured, wherein the second vertical support member of each tri-truss assembly is secured to the first vertical support member of each tri-truss assembly, and wherein the third vertical support member of each tri-truss assembly is secured to at least one of the first and second vertical support members of each tri-truss assembly.

13. The barrier system of claim 12, wherein the third vertical support member of at least one of the first and second tri-truss assemblies is secured to the first vertical support member of the at least one tri-truss assembly such that a plane formed by the first and third vertical support members is at a ninety degree angle with respect to the plane defined by the first and second vertical support members of the at least one tri-truss assembly.

14. The barrier system of claim 12, wherein the third vertical support member of at least one of the first and second tri-truss assemblies is secured to the first vertical support member of the at least one tri-truss assembly such that a plane formed by the first and third vertical support members is at an acute angle with respect to the plane defined by the first and second vertical support members of the at least one tri-truss assembly.

15. The barrier system of claim 12, wherein the third vertical support member of at least one of the first and second tri-truss assemblies is secured to the first vertical support member of the at least one tri-truss assembly such that a plane formed by the first and third vertical support members is at an obtuse angle with respect to the plane defined by the first and second vertical support members of the at least one tri-truss assembly.

16. The barrier system of claim 12, wherein at least one of the first, second, and third vertical support members of at least one of the first and second tri-truss assemblies comprises a pin extending from an end of the support member, and wherein the pin is configured to enter a hole in a surface and provide support for the tri-truss assembly to remain upright.

17. The barrier system of claim 12, wherein at least one of the first, second, and third vertical support members of at least one of the first and second tri-truss assemblies comprises a tapered pin extending from an end of the support member, and wherein the tapered pin is configured to penetrate a surface and provide support for the tri-truss assembly to remain upright.

18. The barrier system of claim 12, wherein the third vertical support member of at least one of the first and second tri-truss assemblies comprises an adjustable support configured to contact a surface and provide support for the at least one tri-truss assembly to remain upright, the adjustable support configured to selectively adjust the effective length of the third vertical support member.

19. The barrier system of claim 18, wherein the adjustable support comprises a threaded member configured to threadably extend from and retract into an end of the third vertical support member.

20. The barrier system of claim 12, wherein the top framework member that extends outward from a plane defined by the first side member of the gate and the second side member of the gate comprises at least one of an angled member, a curved member, and a bowed member.

21. A barrier system comprising:

a first tri-truss assembly comprising three vertical support members, wherein the three vertical support members are arranged in a triangle, such that a plane defined by a first vertical support member and a second vertical support member is at an angle with respect to the plane defined by the second vertical support member and a third vertical support member;

a second tri-truss assembly comprising three vertical support members;

a gate pivotally attached to the first tri-truss assembly and configured to pivot between an open position and a closed position relative to the second tri-truss assembly, wherein the gate comprises:

a first side frame support;

a second side frame support;

a lower cross frame support member connecting the first side frame support and the second side frame support; and an upper cross frame support connecting the first side frame support and the second side frame support, wherein the first side frame support, the second side frame support, and the lower cross frame support are positioned within a first planar region, and wherein at least a portion of the upper cross frame support connects the first and second side frame supports in a second planar region that is different from the first planar region;

a mesh secured to the first side frame support, the second side frame support, and the lower cross frame support, such that the mesh remains unconnected to at least the portion of the upper cross frame support in the second planar region.

* * * * *